United States Patent [19]

Hull et al.

[11] Patent Number: 5,061,945

[45] Date of Patent: Oct. 29, 1991

[54] PORTABLE SATELLITE ANTENNA SYSTEM

[76] Inventors: Harold L. Hull, 401 Canyon Way #43, Sparks, Nev. 89434; Robert L. Service, 145 Ziller Way, Dayton, Nev. 89403

[21] Appl. No.: 479,276

[22] Filed: Feb. 12, 1990

[51] Int. Cl.[5] ..... H01Q 15/20

[52] U.S. Cl. ..... 343/840; 343/882; 343/915

[58] Field of Search ..... 343/882, 878, 881, 765, 343/840, 915, 916

[56] References Cited

U.S. PATENT DOCUMENTS

| | | | |
|---|---|---|---|
| 3,108,279 | 10/1963 | Eisentraut | 343/775 |
| 3,217,328 | 9/1965 | Miller | 343/840 |
| 3,263,232 | 7/1966 | Burwell et al. | 343/916 |
| 3,509,578 | 4/1970 | Cribb | 343/882 |
| 3,541,569 | 9/1970 | Berks | 343/915 |
| 3,631,505 | 12/1971 | Carman | 343/915 |
| 4,352,113 | 9/1982 | Labruyere | 343/915 |
| 4,404,565 | 9/1983 | Gurney | 343/881 |
| 4,482,897 | 11/1984 | Dragone | 343/779 |
| 4,527,166 | 7/1985 | Luly | 343/915 |
| 4,528,569 | 7/1985 | Felter et al. | 343/882 |
| 4,608,571 | 8/1986 | Luly | 343/781 |
| 4,613,870 | 9/1986 | Stonier | 343/915 |
| 4,663,633 | 5/1987 | Wilson | 343/714 |
| 4,683,475 | 7/1987 | Luly | 343/915 |
| 4,792,815 | 12/1988 | Moisdon | 343/915 |
| 4,811,031 | 3/1989 | Maile et al. | 343/840 |

*Primary Examiner*—Michael C. Wimer

[57] ABSTRACT

A portable antenna satellite system which has a dish made of substantially identical segments which fold around a central hub and a handle and horn stem that fold along with a tripod into a compact bundle for transporting and which can be easily and readily opened, stacked to the ground and "aimed" at a satellite.

6 Claims, 5 Drawing Sheets

Fig 12
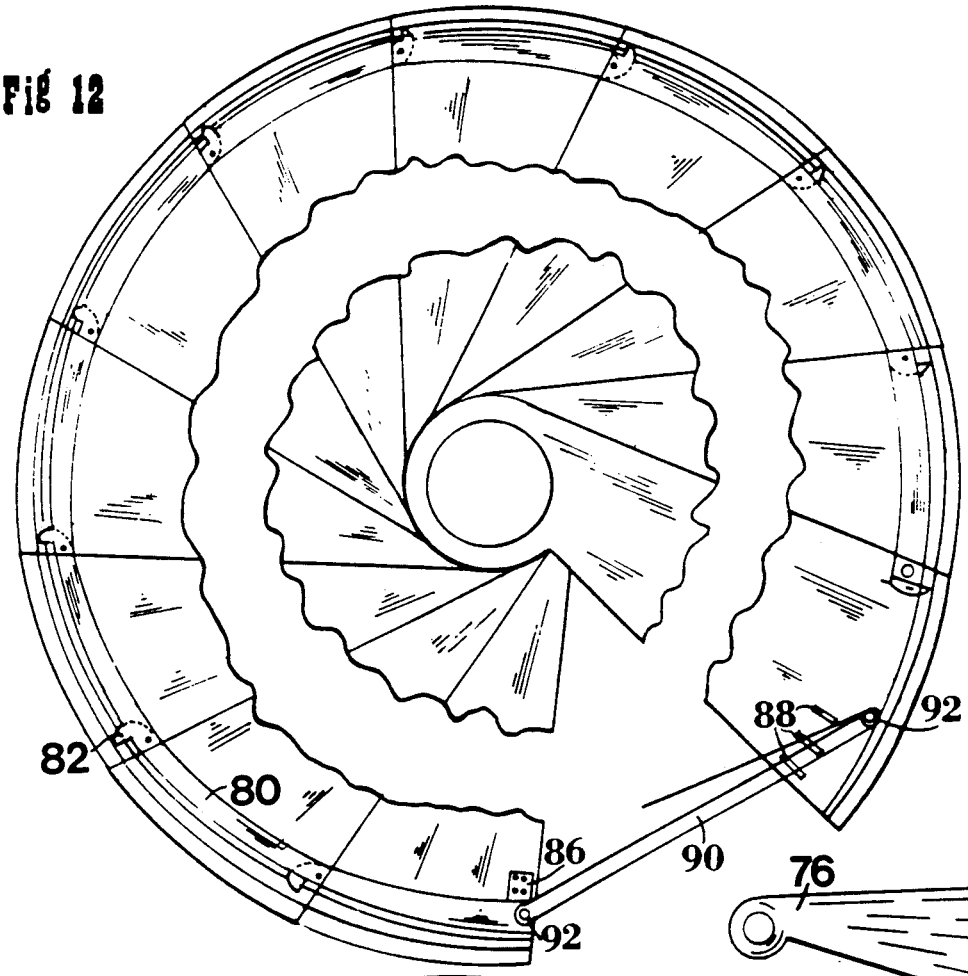
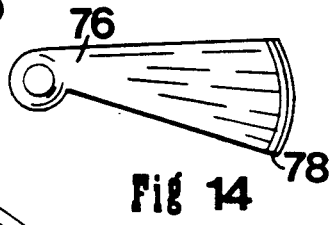
Fig 14
Fig 13
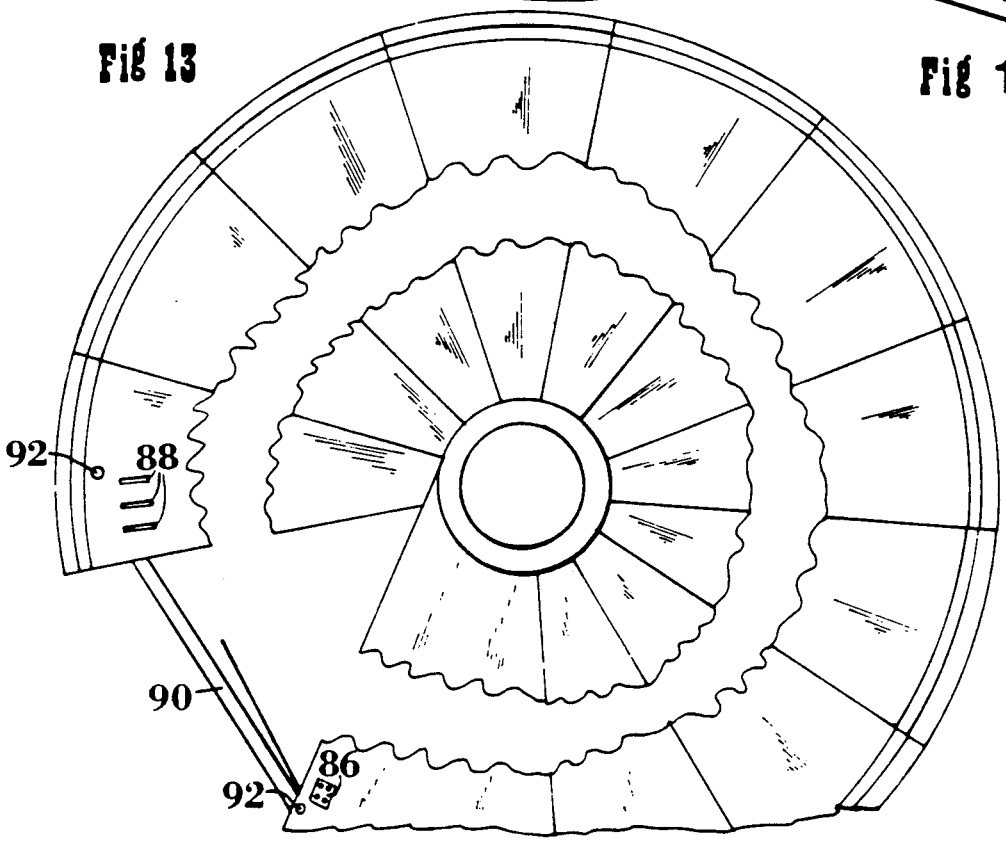

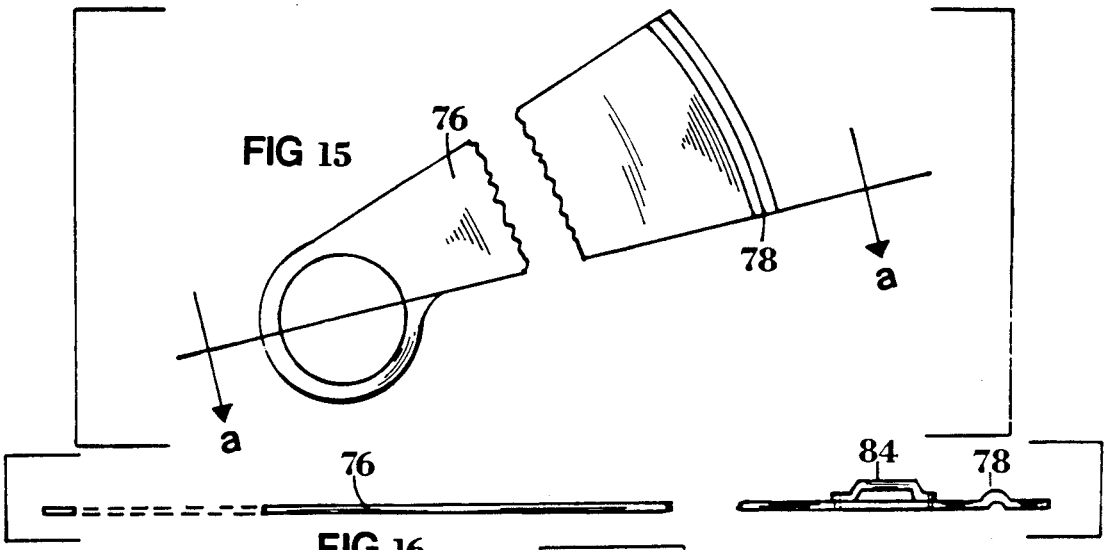
FIG 15
FIG 16
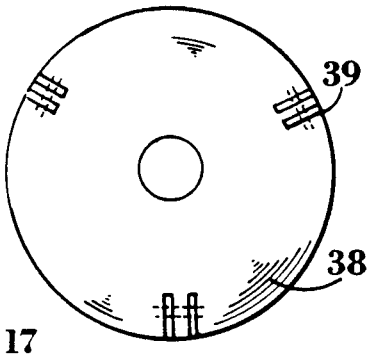
FIG 17
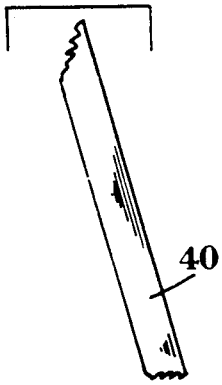
FIG 18
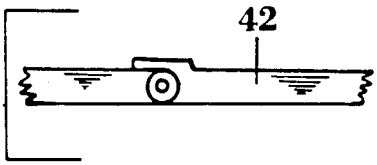
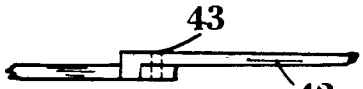
FIG 19
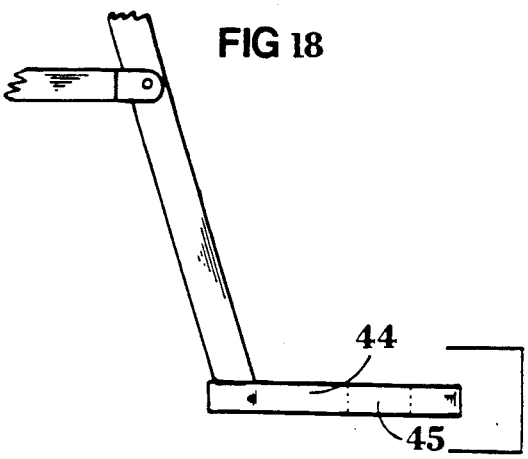
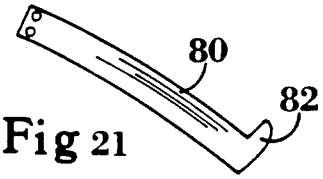
Fig 21
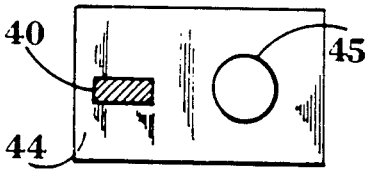
FIG 20

PORTABLE SATELLITE ANTENNA SYSTEM

This invention relates to satellite antenna systems and more particularly to such systems that are fully collapsible and portable.

BACKGROUND OF THE INVENTION

The use of parabolic reflector satellite antenna systems are well known and well documented.

In many electronic applications, an antenna in the form of a dish is employed to transmit energy toward a distant position or to receive energy from a distant position.

Many systems are established for use at a fixed location that is, the location of the antenna does not change. With such stationary systems, the parabolic reflector portion of the antenna remains substantially always in an open, fixed operating position with provision being made for manually or remotely controlling the movement of the arc of the dish through two planes of operation in order to "aim" the dish at a particular satellite.

A more difficult problem exists in providing satellite antenna systems for mobile use as such systems need to be portable, collapsible and compact for storage while in transport, yet readily usable with a minimum amount of assembly required on site. Also, special mounting problems must be addressed with attention being given to means to anchor the mounting device to a surface, as wind and balancing become a problem. Also, "aiming" the dish presents a special problem.

Most of the systems taught present a dish that has a number of ribs, which have attached to them, material such as mesh or pre-formed structures which collapses such at U.S. Pat. No. #3,217,328 which is a wire mesh that furls and unfurls around a central structure or the device of patent U.S. Pat. No. #3,631,5005 which has ribs, interconnecting in a scissors like pattern, extending from a center hub, or the antenna taught by U.S. Pat. Nos. #4,608571 and #4,683,475 which is a complicated arrangement which includes a pre-formed dish reflector of pliable material supported by a radial framework of spokes pivotable by a lever system between a folded axial position and a deployed radial position, similar to a spoked umbrella.

SUMMARY OF THE INVENTION

The present invention teaches a portable, collapsible, compact, lightweight dish, which is made of a plurality of substantially identical pre-shaped sectors each having a pair of opposite side edges together forming an apex portion of each segment, the apex portions being located over each other and connected together for turning movement with respect to each other, about a central axis passing through an apex portion of each segment, with a first and second position, the first position being closed, with each sector lying one on the other in a flat, compact manner, with the second position being open, forming a circular, curved dish when the outer edges are drawn together.

The present invention also discloses a tripod mounting means which can be staked to the ground with a double swivel arrangement connecting the tripod to the dish for manual adjustment, a control handle affixed to the back side of the dish which is foldable, and a foldable arrangement on the inside of the dish for attachment of the horn and the horn stem. The entire arrangement can be folded into a flat, parallel, closed position which can be easily stored in a compact state for transport.

It is therefore a primary object to provide a portable antenna which can be staked to the ground and which can be formed into an adjustable dish with a minimum amount of effort.

It is a further object to provide a portable antenna having a tripod mounting means with the three legs inked together when in an open position and which lay parallel to each other when in a closed position.

Another object is to provide an adjustable, lockable means connecting the center of the dish mechanism with the apex of the tripod.

Still another object is to provide an antenna that in its closed position, has all the components lying in a flat, parallel plane Another object is to provide a dish made of a plurality of sectorial blades which are substantially identical in construction and shape.

Still another object is to provide a dish which is made of material with a solid reflective surface for better performance as opposed to wire mesh or the like.

Yet another object is to provide a handle adjustably affixed to the apex of the tripod and the center structure of the dish which allows the operator to comfortably move, adjust and aim the dish, yet is foldable to a parallel plane with the rest of the device when in a closed position.

Other objects and advantages will become apparent when taken in consideration with the following drawings and specifications.

BRIEF DESCRIPTION OF THE DRAWINGS

FIG. 12 is a view of the back side of the dish in an open but flat position. FIG. 13 is a view of the front of the dish in an open but flat position. FIG. 14 is a detail of one of the sections of the dish in a flat position. FIG. 15 is a detail of one of the sections of the dish in a flat position with an exaggerated hub size. FIG. 16 is an edge view taken at a—'a' of FIG. 15. FIG. 17 is a bottom view of the base plate of the tripod. FIG. 18 is a side view and detail of one of the three legs of the tripod.

FIG. 19 is a top view of the cross brace of FIG. 18.

FIG. 20 is a top view of the foot of one of the legs of the tripod.

FIG. 21 is a side view of a curved section.

DETAIL DESCRIPTION OF THE DRAWINGS

Figure 1:
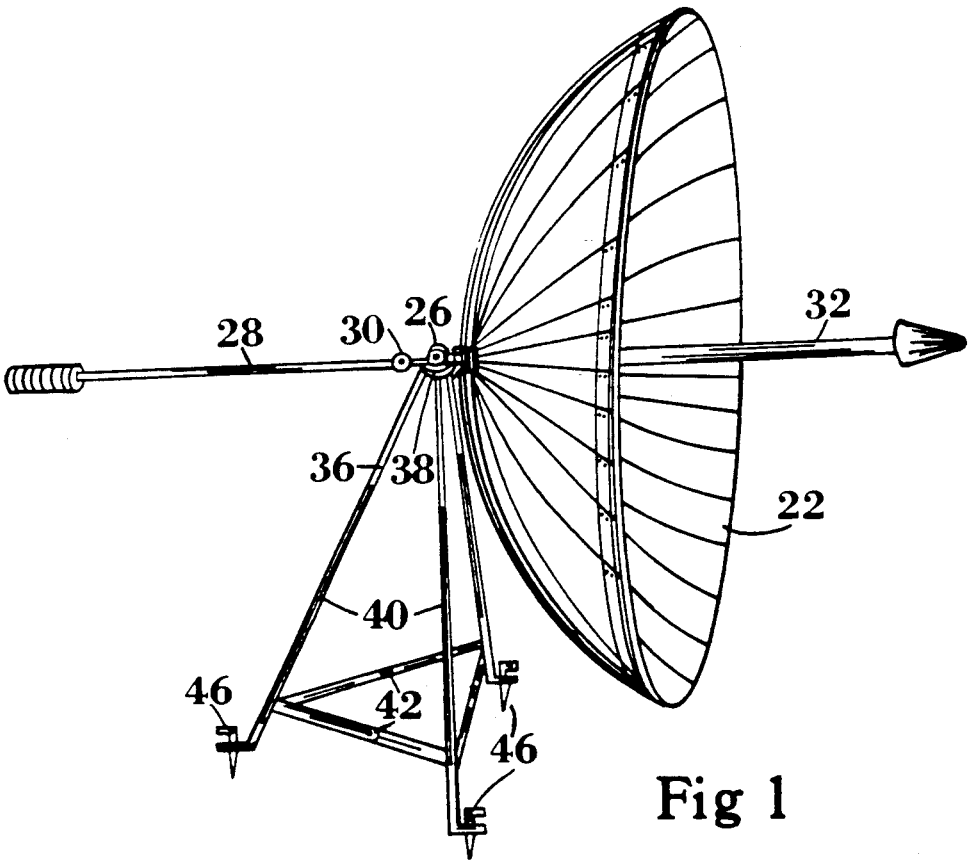
FIG. 1 is a perspective view of the device.
Figure 3:
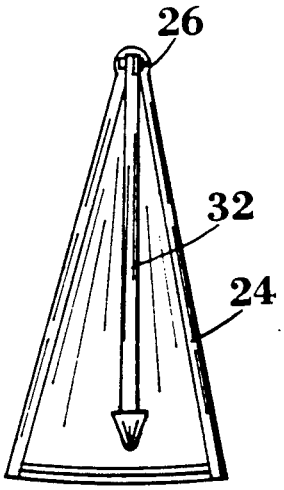
FIG. 3 is a side view of the device in a folded position at a 90 degree angle to FIG. 2.
Figure 2:
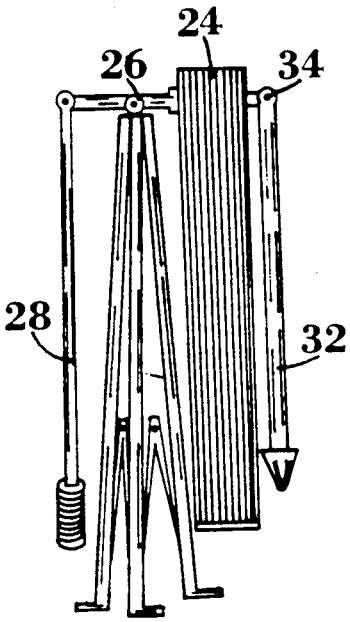
FIG. 2 is a side view of the device in a folded position.
Figure 4:
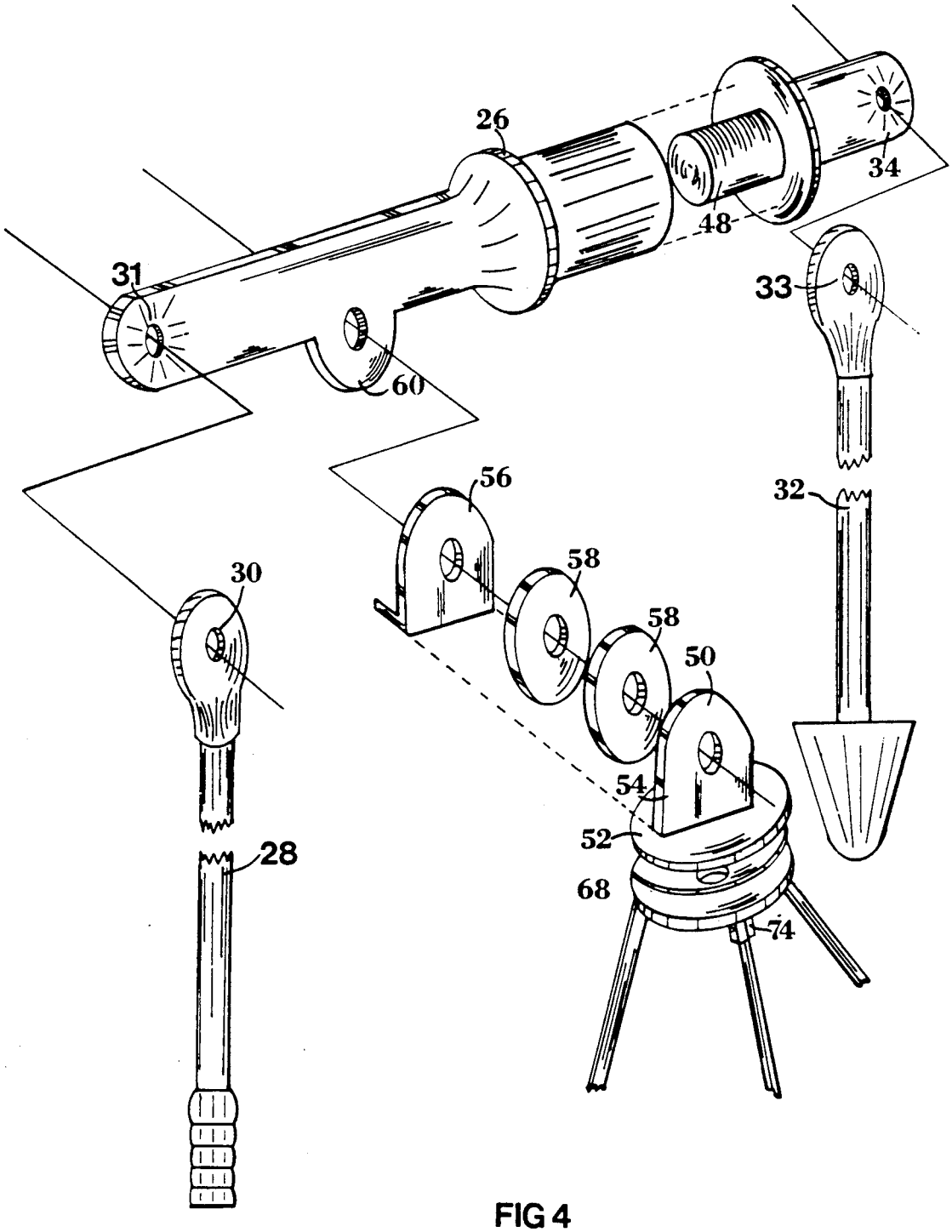
FIG. 4 is a partially exploded view of the hub showing the mounting means of the hub on a tripod, with means to affix the handle and horn stem.
Figure 5:
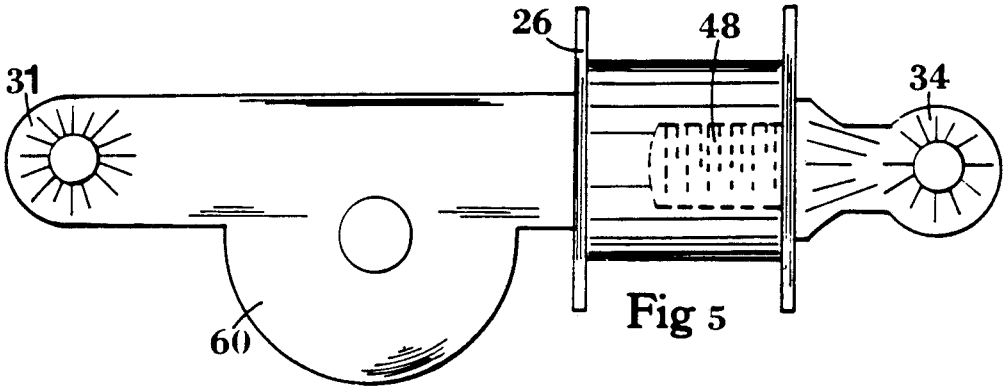
FIG. 5 is a side view of the hub.
Figure 6:
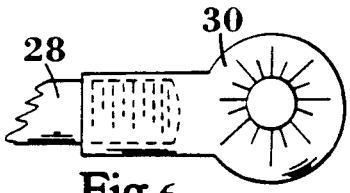
FIG. 6 is a partial side view of one end of the adjustable handle.
Figure 7:
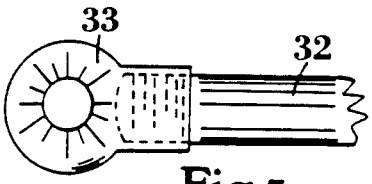
FIG. 7 is a partial side view of one end of the adjustable horn stem.
Figure 8:
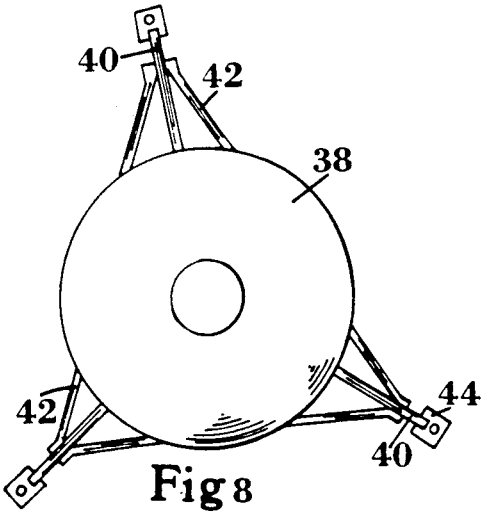
FIG. 8 is a top view of tripod, legs and feet.
Figure 9:
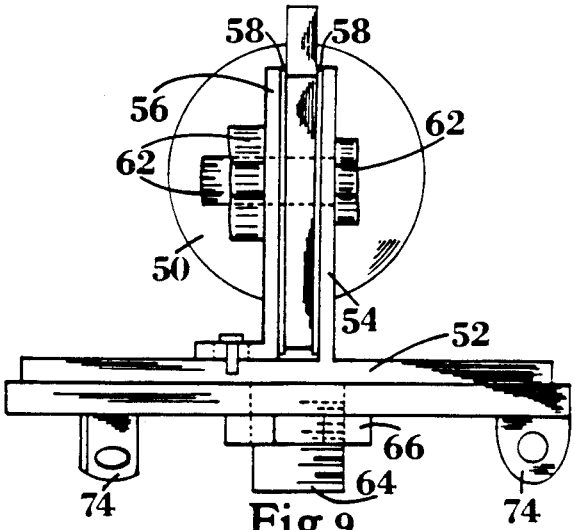
FIG. 9 is an end view of the tripod base, and mounting means of the hub.
Figure 10:
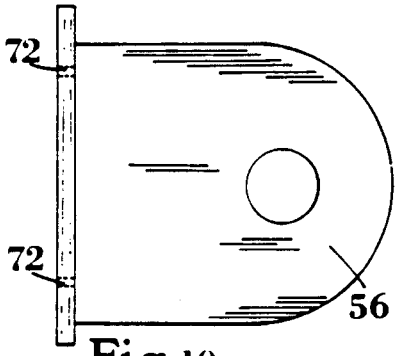
FIG. 10 is a side view of the hub mounting bracket.
Figure 11:
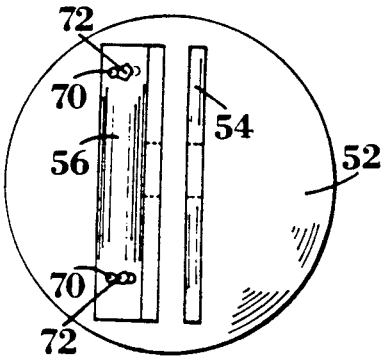
FIG. 11 is a top view of the tripod base and hub brackets.

Referring now in detail to the drawings wherein like numerals refer to like parts throughout the various views, 22 is a parabolic dish made of substantially duplicate sections 24 mounted on a hub 26, with control handle 28 mounted at pivot 30 to pivot 31 of the hub 26, 32 being mounted by pivot 33 to the distal end of hub 26 at pivot 34. The hub 26 is mounted on tripod 36 at the tripod base plate 38, with the upper ends of the legs 40 being pivotable attached to base plate 38 and held in an open or closed position by collapsible braces 42 with lock 43 and 44 being feet through which stakes 46 may be driven in the ground through opening 45.

The hub 26 may be cast as one unit or fabricated with the pivot member 34 being attached to hub 26 by threads 48. 50 is a mounting bracket and pivot means which includes a base plate, 52, upright support member 54 and support member 56, while 58 are washers made Of a material such as NEOPRENE or leather and when the mounting section 60 of hub 26 is held in place between the two washers 58 and anchored by bolt and nut 62, the washers act as a friction joint when the bolt and nut 62 is slightly loosened and firmly locks the hub in a fixed position when bolt and nut 62 is tightened. Also the mounting bracket 50 has a threaded member 64 with nut 66 which anchors the mounting bracket 50 to the base plate 38 of tripod 36, with a washer 68 between them which may be made of NEOPRENE or leather and acts as a friction joint when nut 66 is slightly loosened and firmly locks the mounting bracket 50 to the base plate 38 of the tripod when nut 66 is tightened. The support member 56 is also anchored to base plate 52 by bolts 70 through slots 72 and may be tightened for further support when the dish is secured in a fixed position. 74 are brackets to pivotably mount legs 40 to base plate 38.

In FIG. 12 the parabolic dish is shown in an opened flat position with each section as shown by typical section 76 having a curved rib 78 which cooperates with the adjacent ribs on both sides of it to form a track and strengthening feature while 80 is a curved section affixed to each section 76 and having at its distal end a hook 82, with each curved section 80 and hook 82 cooperating with brackets 84 on each section 76 to support and lock each section to its adjacent sections when in an open position while 86 is an L shaped locking bracket cooperating with slots 88 so that when dish 22 is pulled together into a parabolic shape by rope 90 and pulleys 92, the bracket 86 can slip into one of the slots 88 and hold the dish in a fixed parabolic position while the rope 90 may be tied off to its self to further hold the dish in its parabolic shape.

It will now be seen that we have provided a highly portable antenna dish with a tripod which may be staked to the ground and when the handle is locked into a horizontal position and the horn stem is locked into a horizontal position, the dish may be opened in a flat vertical circle and then the outside edges be drawn together by a rope and pulley arrangement and locked into place which forms a parabolic dish. The dish may be "aimed" in a horizontal and vertical plane by the hub arrangement and locked when the proper position is reached.

We have also provided a highly portable antenna dish and tripod arrangement that can be folded into a bundle substantially in the same plane and easily stored for transport.

Also the dish is of a simple design which uses a plurality of sectorial blades which are substantially identical in construction and shape which makes for economical production. The dish may also be made from solid material as opposed to a mesh material for better performance.

Although the invention has been herein shown and described in what is conceived to be the most practical and preferred embodiment, it is recognized that departures may be made therefrom within the scope of the invention, which is not to be limited to the details disclosed herein but it is to be accorded the full scope of the claims so as to embrace any and all equivalent devices and apparatus.

Having described our invention, what we claim as new and desire to secure by letters patent is:

1. A satellite antenna dish comprising; a tripod, means to attach said tripod to the ground, a dish, a hub, a handle, a horn stem, connecting means to connect said tripod, said dish, said hub, said handle, and said horn stem, said dish being made of a plurality of substantially identical pre-shaped sections, said sections each having a pair of opposite side edges together forming an apex portion of each section, said apex portions being located over each other and connected together for turning movement with respect to each other about said hub, said hub passing through said apex portion of each section, said dish having a first and second position, said first position being closed with each said section lying one on the other in a flat, compact manner, said second position being open, forming a circular, parabolic dish, means to lock together said pres-shaped sections at their distal ends opposite the said apex portions, when in said second position, means to draw together two of the extreme outer said sections, means to lock together said two outer said sections and said dish, said sections, said hub, said handle and said horn stem cooperating together to allow said dish to be moved and locked in horizontal and vertical planes in relation to said tripod, said means to draw together two of the extreme outer sections is a rope and at least one pulley.

2. The device of claim 1 in which said means to attach said tripod to the ground is by stakes.

3. The device of claim 1 in which said sections have at substantially their distal ends opposite the apex portions, curved ribs which cooperate with each other to form a track.

4. The device of claim 1 in which means to lock together said sections at their distal ends opposite the apex portions, are independent substantially curved members, said curved members being affixed at one of their ends to said sections and at the distal ends of said members means to engage and hold the adjacent sections in a fixed relationship when said dish is in its said second open position.

5. The device of claim 4 in which said means to engage and hold the adjacent sections in a fixed relationship is a hook and bracket.

6. The device of claim 1 in which said means to lock together said two outer sections is a L-shaped bracket affixed to one of said outer sections, said bracket cooperating with at least one slot in the other one of said outer sections.

* * * * *